US006393984B1

(12) United States Patent
Kenney

(10) Patent No.: US 6,393,984 B1
(45) Date of Patent: May 28, 2002

(54) INK CAPSULE FOR A PRINTER

(75) Inventor: Christopher Thomas Kenney, High Wycombe (GB)

(73) Assignee: Cap Coder LTD, Chargrove (GB)

( * ) Notice: Subject to any disclaimer, the term of this patent is extended or adjusted under 35 U.S.C. 154(b) by 0 days.

(21) Appl. No.: 09/786,927

(22) PCT Filed: Sep. 9, 1999

(86) PCT No.: PCT/GB99/03005

§ 371 (c)(1),
(2), (4) Date: Mar. 9, 2001

(87) PCT Pub. No.: WO00/15443

PCT Pub. Date: Mar. 23, 2000

(30) Foreign Application Priority Data

Sep. 10, 1998 (GB) ..... 9819623

(51) Int. Cl.[7] ..... B41F 31/02
(52) U.S. Cl. ..... 101/364; 101/335
(58) Field of Search ..... 101/330, 333, 101/340, 364, 202, 335

(56) References Cited

U.S. PATENT DOCUMENTS 3,797,390 A * 3/1974 Marozzi et al. ..... 101/333
3,804,016 A * 4/1974 Marozzi et al. ..... 101/333
4,484,827 A * 11/1984 Price, Jr. ..... 401/205
2001/0022603 A1 * 9/2001 Eida ..... 347/85

FOREIGN PATENT DOCUMENTS

EP 366138 A2 * 1/1995

* cited by examiner

*Primary Examiner*—Daniel J. Colilla
(74) *Attorney, Agent, or Firm*—Paul E Milliken; Ray L Weber

(57) ABSTRACT

An ink capsule and an ink supply for a printer, the capsule (10) comprising a hollow container (11) having a mouth (18) and an inlet port (15), a flexible impermeable liner (17) sealed to the container shell, and which is filled with a resilient polymeric foam (21), with the mouth of the container being closed by a porous disc (22). The ink supply (31) further includes a variable volume fluid reservoir (41) connected to the inlet port (15) for the movement of fluid between the reservoir (41) and the container (11) in response to the expansion and contraction of the reservoir (41).

13 Claims, 2 Drawing Sheets

INK CAPSULE FOR A PRINTER

FIELD

This invention relates to ink capsules for printing machines and in particular for coding machines.

BACKGROUND

Coding machines are typically used for printing indicia on articles to indicate, for example: a date of manufacture, an expiry date, prices, numbers relating to the manufacture or packaging of an article etc.. A known coding machine is the applicant's CC100 coder. The printing head on the coder picks up ink from an ink capsule and prints the indicia on to the article. The ink capsule typically includes an ink retaining pad which is conventionally made from felt. The use of felt works well with conventional solvent based links in which the solvent is typically ethyl alcohol. However solvent based processes are no longer considered desirable in that the solvent creates an unsuitable work environment and the waste products from the process are environmentally unfriendly.

In view of the above problems there is now a trend towards the use of water based printing mediums. Another advantage of water based codes, is that they can, if desired, be removed by washing prior to sale of the marked goods.

The use of an aqueous medium allows for the use of a wide range of different coloured inks, in particular inks which are coloured by the use of pigments. The use of pigmented inks has given rise to problems in that the felt pads filter out the pigment particles. Furthermore, if an alternative ink retentive material is substituted for the felt, the ink capsule tends to leak since in use the face of the ink capsule is generally vertical and the aqueous based inks are not self-sealing, unlike solvent based inks. This may cause an unsightly mess on the article being printed.

OBJECT OF THE INVENTION

The present invention provides an ink capsule for use with aqueous pigmented inks without the above problems.

STATEMENTS OF INVENTION

According to the present invention there is provided an ink capsule for a printer, which comprises a container having a hollow shell with a mouth and an inlet port through the container shell, a flexible impermeable liner sealed to the container shell, the container and liner being filled with a resilient polymeric foam, and the mouth of the container being closed by a porous closure.

The container may be moulded from a suitable plastics material such as a polyolefin, preferably polyethylene in particular a high density polyethylene.

The liner is thin and pliable and is formed form resilient readily deformable material such as an elastomer, for example natural rubber, butyl rubber, nitrile rubber etc., or a laminate of different elastomers. A natural rubber latex has been found particularly suitable. The porous disc is preferably a sintered polymer, more preferably a fluoropolymer.

The foam, which in use retains the ink, is preferably an open cell material such as polyethylene foam, or a polyurethane foam in particular a polyether foam.

The invention also relates to an ink supply for a printer, which includes an ink capsule according to the invention, wherein the supply includes a variable volume fluid reservoir connected to the inlet port of the container allowing for the movement of fluid between the reservoir and the container in response to the expansion and contraction of the reservoir.

Movement of fluid into the container squeezes the foam within the liner forcing ink through the porous closure to be transposed to the printing head, and movement of fluid from the container causes the foam to expand, sucking the excess ink back into the container.

Preferably the reservoir comprises a cylinder having a piston reciprocable therein to displace fluid, being resiliently biased to an equilibrium condition of maximum volume.

The maximum stroke of the piston is adjustable to control the squeeze on the foam in the container by varying the volume of fluid displaced. The squeeze on the foam may alternatively, or additionally, also be adjusted by controlled bleed-off of the fluid displaced.

According to yet another aspect of the invention there is provided a printing machine having an ink supply system as described above for a printing head, wherein the printing head is operated by a pneumatic cylinder which is connected to the reservoir so that a pulse of air pressure to the pneumatic cylinder also pushes fluid into the container.

DESCRIPTION OF THE DRAWINGS

The invention will be described by way of example and with reference to the following drawings in which.

DETAILED DESCRIPTION OF THE INVENTION

Figure 1:
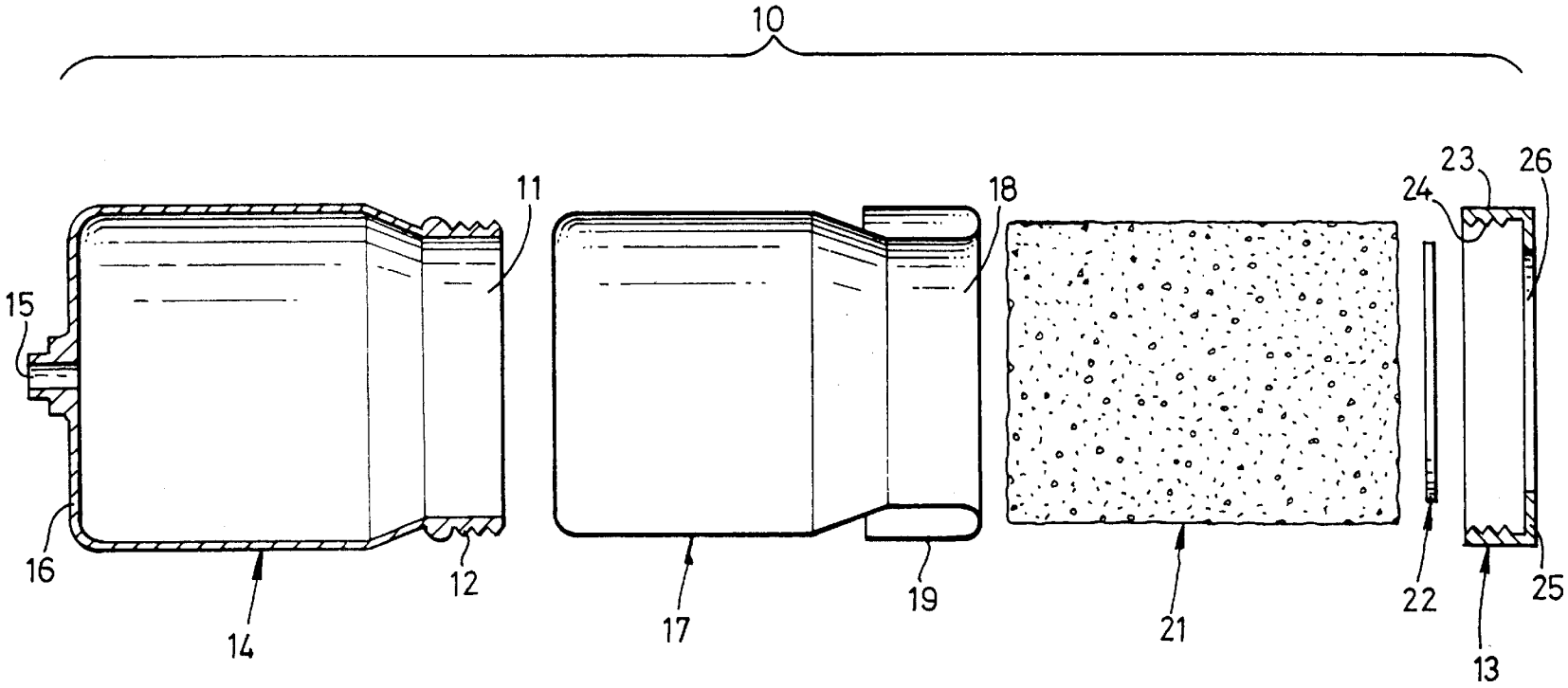
FIG. 1 is an exploded diagram in cross-section of an ink capsule according to the present invention.

With reference to FIG. 1, there is shown an ink capsule 10 for use on a coder printer in particular a CC100 Coder which is sold by the applicant.

The capsule comprises a relatively rigid container 11 moulded from a suitable plastic material e.g. high density polyethylene. The container 11 has a hollow shell 14 with a mouth 11 having an external screwthread 12 formed thereon for the attachment of a cap 13. The container shell 14 is provided with an inlet port 15 passing through base 16 of the container.

The container 11 has an impermeable flexible rubber liner 17 inserted therein to lie adjacent the shell 14 with the mouth 18 of the liner 17 having a portion 19 extending back on itself for sealing between the container 11 and cap 13. The container 10 and linear 17 are filled with a block of foam 21 which is a resilient open cell foam, preferably a polyether based polyurethane foam. The density of the foam should be about 20–30 Kg per cubic meter, preferably 24–27 Kg per cubic meter. In use the foam contains the printing ink.

The mouth 18 of the liner is closed by a semi-rigid porous disc 22 which is formed from a sintered polymer, preferably a fluoropolymer, preferably PTFE and is about 2 mm thick. The disc 22 is held in place in the mouth 18 by the cap 13. The cap 13 has a cylindrical sidewall 23 with an internal screwthread 24 which cooperates with the external thread 12 on the container. The end wall 25 of the cap 15 has an aperture 26 therein whereby a printing head (see FIG. 3) may access the ink.

Figure 2:
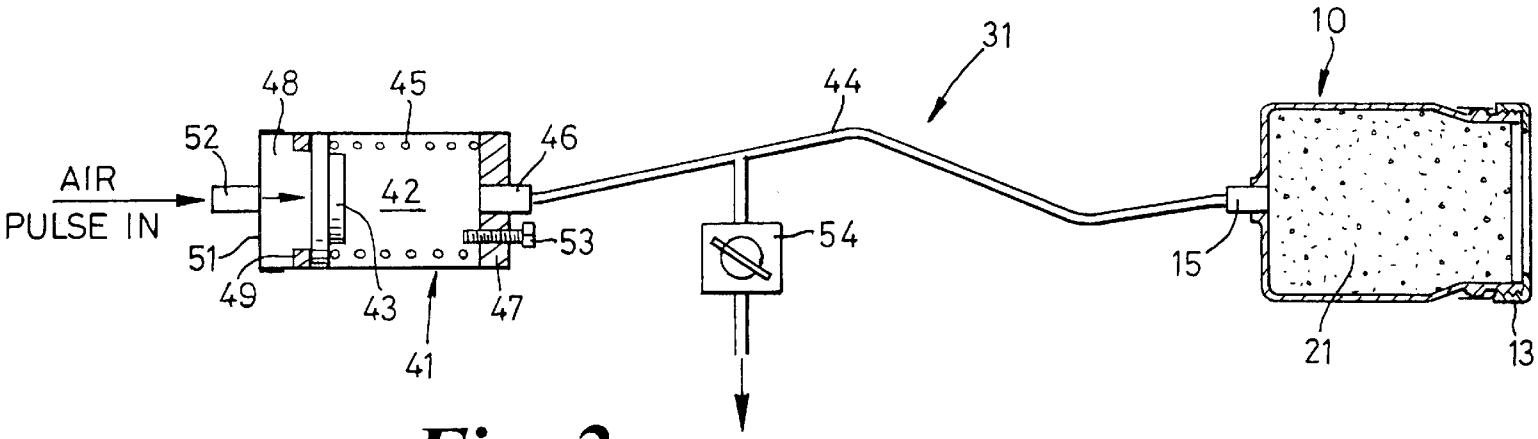
FIG. 2 is a schematic drawing of an ink supply system for a printer which incorporates a capsule as shown in FIG. 1.

With reference to FIG. 2, the capsule 10 is incorporated in an ink supply 31 for a printer. The ink supply 31 comprises a fluid reservoir 41 in the form of a cylinder having a cylindrical fluid chamber 42 with a piston 43 reciprocable within the chamber 42 to vary the volume of the chamber. The chamber 42 is connected through an outlet port 46 in its endwall 47, and via conduit 44, preferably a flexible pipe, to the inlet port 15 of the capsule 10 so that a movement of the piston 43 within the cylinder 41 causes the movement of fluid between the cylinder 41 and capsule 10.

A return spring 45 is located in the chamber 42 to bias the piston to an equilibrium position against a stop 49 so that the chamber 42 is at maximum volume in the at-rest condition. The external side of the piston 43 is open to a second chamber 48 formed in the cylinder 41 between the piston and an end cap 51. The end cap 51 is connected through an inlet port 52 to a source of pulsed air pressure (not shown).

A pulse of high pressure air enters the inlet port 52 causing the piston 43 to move towards the cylinder endwall 47 displacing fluid, preferably air, from the chamber 42 into the capsule 10 via the pipe 44. The displaced air enters the capsule 10 through the inlet port 15 causing the flexible liner 17 to distort and thereby squeeze and distort the foam 21. Any ink retained in the foam 21 is pushed through the porous disc 22 to lie on the exposed open surface for contact with a printing head. When the air pulse stops, the spring 45 biases the piston to its at-rest condition drawing the air from the capsule back into the chamber 42 which sucks the surplus ink back into the capsule.

The volume of air displaced by the piston 43 should be about 50% of the volume of the container 11. The actual volume may be controlled by having a variable position stop 53 mounted in the endwall 47. The stop 53 may be an adjustable screw passing through the end wall. The position of the stop 53 will be adjusted to give optimum ink delivery to the surface of the disc 22. This will be dependent upon many factors including the ink viscosity, porosity of the disc, density and resilience of the foam, so that the actual stop position will be determined by trial.

The volume of air displaced may also need to be adjusted during the operating life of the capsule 10 to compensate for changes in falling ink levels in the capsule, and changes in viscosity in the ink. An adjustable regulator 54 is connected to the pipe 44 between the fluid reservoir 41 and the capsule 10. The flow regulator allows for a controlled exhausting, or bleed-off, of the displaced air into the atmosphere.

Figure 3:
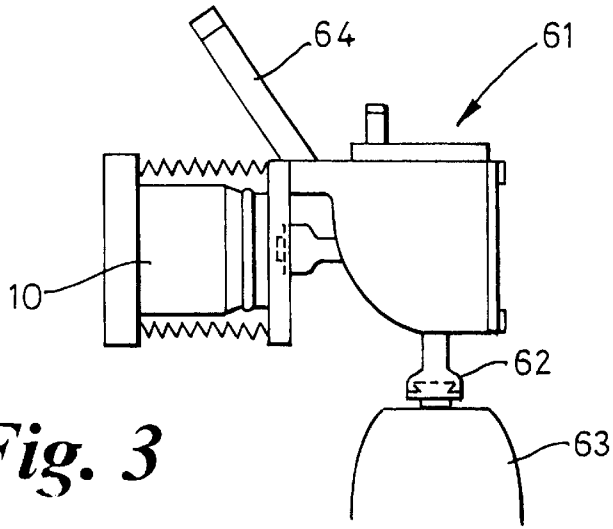
FIG. 3 is a printing head incorporating the capsule of FIG. 1.

With reference to FIG. 3, there is shown a printer 61 from a reciprocating coder having a printing head 62 moved between the ink capsule 10 and an article to be printed 63 by a pneumatic cylinder 64. The cylinder 64 is operated by pulses of high pressure air (about 40 psi, that is about 3 bar) to cause the head 62 to print. These air pulses can also be used to operate the piston 43 to squeeze ink through the disc 22 ready for transfer to printing head.

The volumes of ink displaced through the disc are very small for example a capsule of about 90 gms. of ink will print at least 50,000 codes and probably up to 100,000 codes.

What is claimed is:

1. An ink capsule for a printer which comprises a hollow container having a mouth and an inlet port passing through a container shell, a flexible impermeable liner sealed to the container shell, the container and liner being filled with a resilient polymeric foam, and the mouth of the container being closed by a porous closure.

2. An ink capsule as claimed in claim 1, wherein the flexible liner is an elastomeric liner sealed to the container mouth.

3. An ink capsule as claimed in claim 1, wherein the polymeric foam is an open cell polyether foam.

4. An ink capsule as claimed in claim 1 wherein the porous closure is a semi-rigid disc held in the mouth of the container by an overcap having an aperture therein to accommodate a printing head.

5. An ink capsule as claimed in claim 4, wherein the disc is formed from a sintered polymer.

6. An ink supply for a printer and which includes an ink capsule as claimed in claim 1, wherein the supply includes a variable volume fluid reservoir connected to the inlet port of the container allowing for the movement of fluid between the reservoir and the container in response to the expansion and contraction of the reservoir.

7. An ink supply as claimed in claim 6 wherein the reservoir comprises a cylinder having a piston reciprocable therein to displace fluid, with the piston being resiliently biased to an equilibrium condition of maximum volume.

8. An ink supply as claimed in claim 7, wherein the maximum stroke of the piston is adjustable to control the squeeze exerted on the foam within the liner by the transported fluid.

9. An ink supply as claimed in claim 6, wherein the displaced fluid is a gas, preferably air.

10. An ink supply as claimed in claim 6, wherein the piston is housed in a closed cylinder with its external face exposed to pulses of high pressure air, and is movable to displace fluid to the capsule by a pulse of air acting on the external face of the piston.

11. An ink supply as claimed in claim 6, wherein an adjustable bleed-off valve is located in the connection between the variable volume reservoir and the inlet port of the container.

12. A printing machine having an ink supply system for a printing head and which is as claimed in claim 6.

13. A printing machine having an ink supply system for a printing head and which is as claimed in claim 10, wherein the printing head is operated by a pneumatic cylinder which is connected to the closed cylinder of the reservoir so that a pulse of air pressure to the pneumatic cylinder also displaces the piston to push fluid into the container.

* * * * *